US009447616B2

(12) United States Patent
Leary et al.

(10) Patent No.: US 9,447,616 B2
(45) Date of Patent: Sep. 20, 2016

(54) WINDOW OPENING CONTROL DEVICE

(71) Applicant: Vinylast, Inc., Lakewood, NJ (US)

(72) Inventors: Steven J. Leary, Barnegat, NJ (US); Benjamin Yin, Hong Kong (HK)

(73) Assignee: Vinylast, Inc., Lakewood, NJ (US)

( * ) Notice: Subject to any disclaimer, the term of this patent is extended or adjusted under 35 U.S.C. 154(b) by 19 days.

(21) Appl. No.: 13/964,596

(22) Filed: Aug. 12, 2013

(65) Prior Publication Data

US 2015/0040485 A1 Feb. 12, 2015

(51) Int. Cl.
*E05C 17/46* (2006.01)
*E05C 17/36* (2006.01)

(52) U.S. Cl.
CPC ..... *E05C 17/36* (2013.01)

(58) Field of Classification Search
CPC ..... E05C 17/36
USPC ..... 49/141
See application file for complete search history.

(56) References Cited

U.S. PATENT DOCUMENTS

| | | | | |
|---|---|---|---|---|
| 295,901 | A * | 4/1884 | Blank et al. | 160/248 |
| 914,180 | A * | 3/1909 | Patterson | 160/244 |
| 3,211,211 | A * | 10/1965 | Youngs | 160/243 |
| 4,450,899 | A * | 5/1984 | Jakobsson et al. | 165/279 |
| 5,159,974 | A * | 11/1992 | Victory, Jr. | 165/96 |
| 5,638,884 | A * | 6/1997 | Lin | 160/370.22 |
| 5,785,105 | A * | 7/1998 | Crider et al. | 160/243 |
| 7,779,900 | B2 * | 8/2010 | Ito et al. | 165/202 |
| 2003/0232590 | A1 * | 12/2003 | Okumura et al. | 454/121 |
| 2005/0215190 | A1 * | 9/2005 | Okumura et al. | 454/121 |
| 2005/0287943 | A1 * | 12/2005 | Tokunaga et al. | 454/143 |

* cited by examiner

*Primary Examiner* — Katherine Mitchell
*Assistant Examiner* — Scott Denion

(57) ABSTRACT

One embodiment of window opening control device that limits the maximum amount by which a window can be opened includes a spool assembly for varying the amount by which the window can be opened and a slider assembly for engaging the spool assembly such that the amount by which the window can be opened does not exceed the maximum amount.

15 Claims, 3 Drawing Sheets

WINDOW OPENING CONTROL DEVICE

BACKGROUND OF THE DISCLOSURE

Window opening control devices are devices that restrict the size of the open area of a window so that it is too small for a young child (e.g., five years of age or younger) to fall through. Specifically, window opening control devices allow the window opening to be set at a predetermined position.

For instance, the United States Consumer Product Safety Commission (CPSC) has advised caregivers to open windows less than four inches when a young child is present. Similarly, the American Society of Testing and Materials' (ASTM) Standard Specification for Window Fall Prevention Devices With Emergency Escape (Egress) Release Mechanisms (ASTM Designation F2090-10) specifies that "no space shall exist at the lowest opening portion of the window opening, that would permit the passage of a rigid sphere measuring 4.0 in. (102 mm) in diameter (Section 5.1.1, supra). However, the window may be opened further with an additional operation such as an operation performed using a key, a tool, or special knowledge.

Although numerous window opening control devices have been developed for double hung and slider type windows, no such devices have been widely disseminated for use with casement style windows (i.e., windows that are attached to their frames by one or more hinges).

SUMMARY OF THE INVENTION

One embodiment of window opening control device that limits the maximum amount by which a window can be opened includes a spool assembly for varying the amount by which the window can be opened and a slider assembly for engaging the spool assembly such that the amount by which the window can be opened does not exceed the maximum amount.

BRIEF DESCRIPTION OF THE DRAWINGS

The teachings of the present invention can be readily understood by considering the following detailed description in conjunction with the accompanying drawings, in which.

To facilitate understanding, identical reference numerals have been used, where possible, to designate identical elements that are common to the figures.

DETAILED DESCRIPTION

In one embodiment, the invention is a window opening control device. The device is especially useful in controlling the size of the open area of a window that is attached to its frame by one or more hinges, such as a casement, awning, or hopper style window; however, it could conceivably also be used with other hinged structures. In one embodiment, the device limits the open area of the window to no more than four inches (i.e., such that a rigid sphere having a diameter of greater than four inches cannot pass through the open area); however, a built-in release mechanism allows the window to be open further upon activation.

Figure 1:
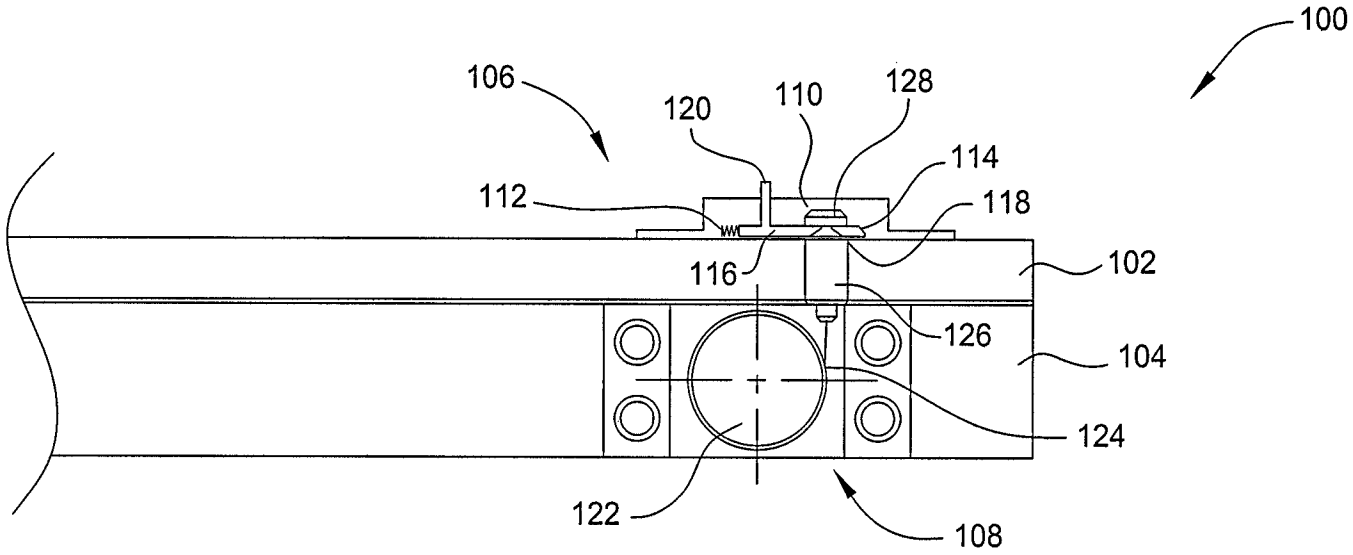
FIG. 1 is a side cross sectional view illustrating one embodiment of a window opening control device, according to the present invention.

FIG. 1 is a side cross sectional view illustrating one embodiment of a window opening control device 100, according to the present invention. In particular, FIG. 1 illustrates the device 100 as installed in a closed window. The window comprises a frame 102 and a pane 104, which are attached along a side by one or more hinges (not shown). While the frame 102 is fixed in place, the hinges allow the pane 104 to be rotated away from the frame 102, thereby opening the window.

The window opening control device 100 generally comprises a slider assembly 106 and a spool assembly 108, which cooperate to control the size of the open area of the window. In one embodiment, the slider assembly 106 is installed in the frame 102, while the spool assembly 108 is installed in the pane 104; however, in other embodiments, the slider assembly 106 may be installed in the pane 104, while the spool assembly 108 is installed in the frame 102.

The slider assembly 106 comprises a slider housing 110 and a slider clamp 112. As illustrated, the slider clamp 112 is largely housed within the slider housing 110. The slider clamp 112 comprises a plate, which is broken into at least a first portion 114 and a second portion 116. The first portion 114 and the second portion 116 are positioned in a spaced apart relation such that an aperture 118 is defined therebetween. The first portion 114 is substantially fixed in place, while the second portion 116 is moveable in a direction away from the first portion 114 by means of a lever 120 (which may be manually activated). The second portion 116 is biased toward the first portion 114 (e.g., using a spring or other biasing means) such that when the lever 120 is not engaged, the aperture 118 is open to a first size. When the lever 120 is engaged, the aperture 118 opens by an amount that is variable up to a second size that is greater than the first size. The slider housing 110 may include a slot (not shown) within which the lever 120 is allowed to slide. Alternatively, no housing may be needed to house the slider clamp 112, and the lever 120 may slide along a track.

The spool assembly 108 comprises a spool 122 around which is wound a length of cable 124. The cable 124 has a fixed end that is attached to the spool 122 and a free end that is attached to a rod 126. The rod 126 further includes a button 128 formed in one end.

As illustrated in FIG. 1, when the window is held in the closed position, the rod 126 is disposed through the aperture 118 defined in the slider clamp 112. The second portion 116 of the slider clamp 112 is biased toward the first portion 114 of the slider clamp 112, such that that first portion 114 and the second portion 116 clamp the button 128 of the rod 126, thereby pulling the pane 104 toward the frame 102 (such that the window is held in the closed position).

Figure 2:
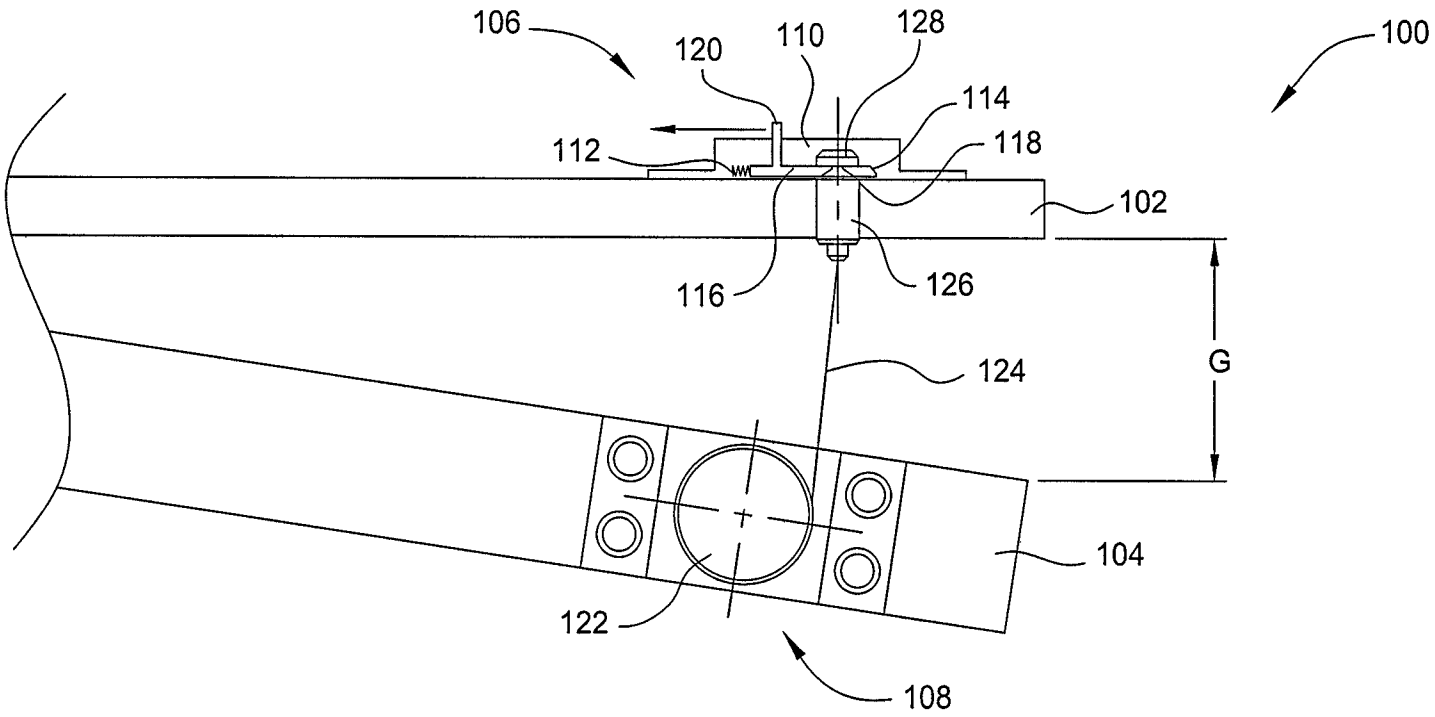
FIG. 2 is a side cross sectional view illustrating operation of the window opening control device of FIG. 1 when the window is held in a controlled open position, according to the present invention.

FIG. 2 is a side cross sectional view illustrating operation of the window opening control device 100 of FIG. 1 when the window is held in a controlled open position, according to the present invention. As illustrated, the rod 126 of the spool assembly 108 is clamped by the slider clamp 112, much as when the window is held in the closed position. However, rotation of the window pane 104 away from the frame 102 causes unspooling of the cable 124 from the spool 122. The maximum or threshold amount by which the window may be open in this controlled manner is thus limited by the length of the cable 124. In one embodiment, the length of the cable 124 is measured such that the gap G between the frame 102 and the pane 104 can be no more than four inches at its widest part.

Figure 3:
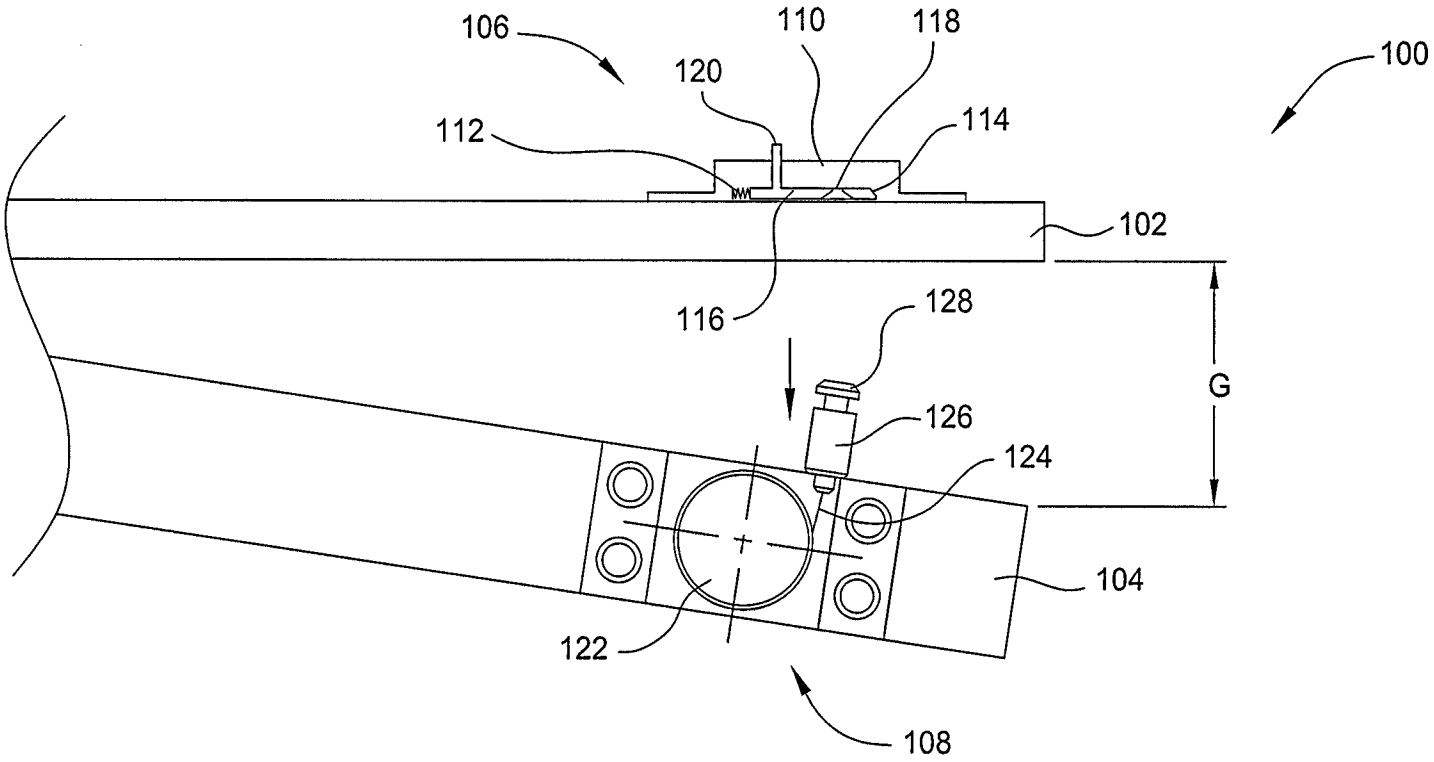
FIG. 3 is a side cross sectional view illustrating operation of the window opening control device of FIG. 1 when the window is held in an uncontrolled open position, according to the present invention.

As discussed above, the window opening control device 100 includes a built in release mechanism that allows the window to be open further than the controlled amount upon activation. This activation is illustrated in FIG. 3, which is a side cross sectional view illustrating operation of the window opening control device 100 of FIG. 1 when the window is held in an uncontrolled open position, according to the present invention. As illustrated, the lever 120 is used to slide the second portion 116 of the slider clamp 112 in a direction away from the first portion 114 of the slider clamp 112, such that the aperture 120 is enlarged enough to release the rod 126 of the spool assembly 108. When the rod 126 is released, the window pane 104 is no longer tethered to the frame 102 by the cable 124, and is free to open to the maximum amount allowed by the tolerances of the window. In one embodiment, this maximum amount is large enough that the gap G is greater than four inches at its widest part.

Thus, the window opening control device 100 controls the amount by which a window may be opened in a manner that is consistent with at least CPSC and ASTM standards for child safety. Specifically, the spool assembly 108 varies the amount by which the window can be opened, while the slider assembly 106 engages the spool assembly 108 to ensure that the window is not opened by an amount that is greater than a defined maximum amount (e.g., four inches, although the maximum amount is variable in other embodiments and may be user defined). Moreover, the built in release mechanism allows the controls enforced by the window opening control device 100 to be overridden by a further operation (e.g., manual activation).

Although various embodiments which incorporate the teachings of the present invention have been shown and described in detail herein, those skilled in the art can readily devise many other varied embodiments that still incorporate these teachings.

What is claimed is:

1. An apparatus for limiting a maximum amount by which a window is opened, the apparatus comprising:

a spool assembly for varying an amount by which the window is opened, wherein the spool assembly is configured for installation in a moveable portion of the window; and a slider assembly for engaging the spool assembly such that the amount by which the window is opened does not exceed the maximum amount, wherein the slider assembly is configured for installation on a fixed portion of the window, and wherein the slider assembly comprises:

a housing configured for mounting to an exterior surface of the fixed portion of the window;

a first plate positioned directly between the housing and the exterior surface of the fixed portion of the window and having a fixed position;

a second plate positioned directly between the housing and the exterior surface of the fixed portion of the window and having a moveable position that is biased toward the first plate; and an aperture of variable size defined between the first plate and the second plate.

2. The apparatus of claim 1, wherein the slider assembly engages the spool assembly in a releasable manner.

3. The apparatus of claim 1, wherein the spool assembly comprises:

a spool;

a cable wound around the spool, where a fixed end of the cable is attached to the spool; and a rod attached to a free end of the cable.

4. The apparatus of claim 3, wherein the rod further comprises a button formed in one end of the rod.

5. The apparatus of claim 3, wherein a length of the cable is measured to limit the amount by which the window is opened to the maximum amount.

6. The apparatus of claim 1, wherein the aperture engages a portion of the spool assembly when the variable size is set to a first size.

7. The apparatus of claim 6, wherein the aperture releases the portion of the spool assembly when the variable size is set to a second size that is larger than the first size.

8. The apparatus of claim 1, wherein the second plate comprises a lever for sliding the second plate in a direction away from the first plate.

9. A window, comprising:

a window frame that is fixed in position;

a window pane that is moveable relative to the window frame; and a window opening control device, comprising:

a spool assembly installed in the window pane for varying an amount by which the window pane is moved; and a slider assembly installed on the window frame for engaging the spool assembly such that the amount by which the window pane is moved does not exceed a maximum amount, wherein the slider assembly comprises:

a housing mounted to an exterior surface of the window frame;

a first plate positioned directly between the housing and the exterior surface of the window frame, wherein the first plate has a fixed position; and a second plate positioned directly between the housing and the exterior surface of the window frame, wherein the second plate has a moveable position that is biased toward the first plate.

10. The window of claim 9, wherein the window further comprises:

at least one hinge coupling the window pane to the window frame.

11. The window of claim 9, wherein the maximum amount is approximately four inches.

12. The window of claim 9, wherein the slider assembly engages the spool assembly in a releasable manner.

13. The window of claim 9, wherein the spool assembly comprises:

a spool;

a cable wound around the spool, where a fixed end of the cable is attached to the spool; and a rod attached to a free end of the cable.

14. The window of claim 13 wherein a length of the cable is measured to limit the amount by which the window pane is moved to the maximum amount.

15. The window of claim 9, wherein the slider assembly further comprises an aperture of variable size defined between the first plate and the second plate, wherein the aperture engages a portion of the spool assembly when the variable size is set to a first size and releases the portion of the spool assembly when the variable size is set to a second size that is larger than the first size.

* * * * *